US006792122B1

(12) United States Patent
Okada et al.

(10) Patent No.: US 6,792,122 B1
(45) Date of Patent: Sep. 14, 2004

(54) ACOUSTIC DEVICE

(75) Inventors: Haruo Okada, Tokyo (JP); Shunichi Takahashi, Saitama-ken (JP); Takashi Ohyaba, Saitama-ken (JP); Tohru Nagatani, Saitama-ken (JP); Katsutoki Hanayama, Saitama-ken (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/457,348

(22) Filed: Dec. 9, 1999

(30) Foreign Application Priority Data

Dec. 28, 1998 (JP) ..... 10-373128

(51) Int. Cl.[7] ..... H04R 25/00
(52) U.S. Cl. ..... 381/151; 381/380; 381/378
(58) Field of Search ..... 381/151, 152, 381/326, 367, 376, 378, 380, 396; 181/171, 179, 181

(56) References Cited

U.S. PATENT DOCUMENTS 1,969,559 A * 8/1934 Kelly ..... 381/380
2,249,572 A * 7/1941 Lieber ..... 381/381
2,681,389 A * 6/1954 Shaper ..... 381/380
3,125,646 A * 3/1964 Lewis ..... 381/326
5,867,582 A * 2/1999 Nagayoshi ..... 381/380
5,903,076 A * 5/1999 Suyama ..... 381/396
5,986,813 A * 11/1999 Saikawa et al. ..... 359/630
6,233,345 B1 * 5/2001 Urwyler ..... 381/327
6,298,249 B1 * 10/2001 Locarno et al. ..... 381/380
6,603,863 B1 * 8/2003 Nagayoshi ..... 381/380

* cited by examiner

*Primary Examiner*—Suhan Ni
(74) *Attorney, Agent, or Firm*—Arent Fox

(57) ABSTRACT

An audio device has an electroacoustic transducer mounted on a clamp for converting an electric signal into an acoustic signal, an electromechanical vibration transducer for converting the electric signal into a mechanical vibration, and an abutting member having the electromechanical vibration transducer therein and mounted on the clamp so that the electromechanical vibration transducer is contacted with a cervix of a user when the audio device is worn on the head of the user.

10 Claims, 7 Drawing Sheets

ACOUSTIC DEVICE

BACKGROUND OF THE INVENTION

The present invention relates to a headphone which is applied to ears of a user for private listening to music, watching a movie, or playing a video game, and more particularly to a headphone capable of providing the user with both auditory sensation, that is sounds, and bodily sensation, that is vibrations.

It is known that, when listening to music, if low frequency components in music signal are applied to the listener as vibrations as well as sounds through loudspeakers, the music can be enjoyed in a more stimulating manner.

In a conventional system using a headphone, there is provided a vibrator in or around an ear pad which is formed at each end of a headset. Thus vibrations are applied by way of the ear pad or the surrounding portions thereof.

In such a conventional system, the audio signals are applied to the tympanum as sounds through the ear pad, and at the same time, the vibrations are applied to the skin of the ear or the surrounding portions thereof through the same ear pad. Thus the sound, which is the auditory sensation, and the vibration, which is the bodily sensation, are both applied at substantially the same portion of the human body. Hence the auditory sensation and the bodily sensation are intermingled, thereby rendering it difficult to sufficiently feel the bodily sensation. Moreover, the sound caused by the vibrations becomes oppressive to the head, and hence discomforting to the listener.

SUMMARY OF THE INVENTION

An object of the present invention is to provide an audio device wherein a sufficient bodily sensation is applied without giving unpleasantness to the listener.

According to the present invention, there is provided an audio device comprising an electroacoustic transducer mounted on a clamp for converting an electric signal into an acoustic signal, an electromechanical vibration transducer for converting the electric signal into a mechanical vibration, and an abutting member having the electromechanical vibration transducer therein and mounted on the clamp so that the electromechanical vibration transducer is contacted with a cervix of a user when the audio device is worn on the head of the user.

The electromechanical vibration transducer is provided with an elastic abutting member so disposed to contact the cervix of the user when the audio device is worn on the head.

The electromechanical vibration transducer has a vibration generator and is mounted in a housing by a resilient supporting member.

The electromechanical vibration transducer has a motor and an eccentric member mounted on a rotating shaft of the motor.

The electroacoustic transducer is mechanically insulated from the electromechanical vibration transducer.

The electroacoustic transducer may be flexibly connected to the electromechanical vibration transducer.

The electromechanical vibration transducer is driven by a low frequency component of the electric signal.

The audio device further comprises a timbre controlling means for controlling a timbre dependent on the electric signal in accordance with the vibration generated by the electromechanical vibration transducer and applying the controlled electric signal to the electroacoustic transducer.

These and other objects and features of the present invention will become more apparent from the following detailed description with reference to the accompanying drawings.

DETAILED DESCRIPTION OF THE PREFERRED EMBODIMENT

Figure 1:
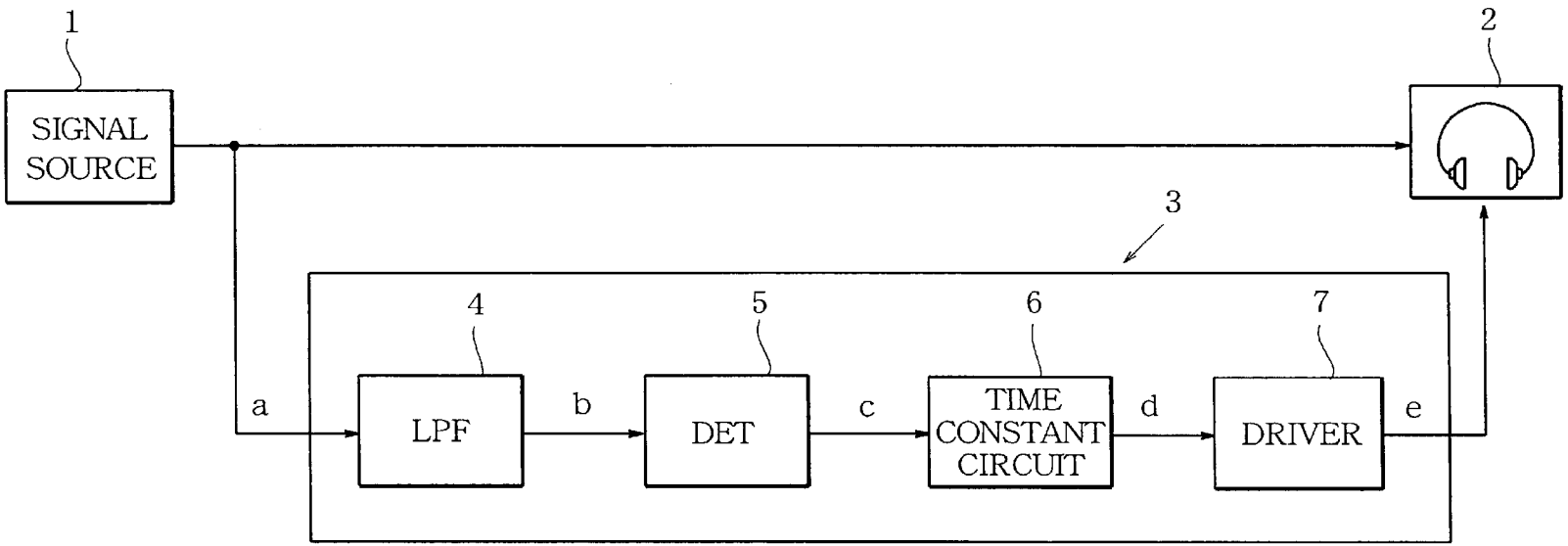
FIG. 1 is a block diagram showing an embodiment of the present invention.

Referring to FIG. 1, a signal source 1 of an audio signal a including an amplifier is connected to a headphone 2 and also to a motor driving section 3. The motor driving section 3 converts low frequency components included in the audio signal a, which sufficiently represent a rhythm of the music, into a motor driving voltage.

More particularly, the low frequency components which sufficiently represent the rhythm of the music is a frequency components lower than 300 Hz, and in the present embodiment, the components lower than 150 Hz is used. Accordingly, the motor driving section 3 has a low-pass filter (LPF) 4 to which the audio signal a is applied to extract a low pass output b which is under 150 Hz. The low pass output b is detected at a detector circuit 5 so as to extract a direct current component c including the low frequency component.

The direct current component c is fed to a time constant circuit 6 so that a change in the direct current component c becomes gradual. An output d of the time constant circuit 6 is fed to a driver 7 to produce a motor driving voltage e which is applied to the headphone 2. Namely, although the direct current component c including the low frequency may abruptly change in a short time, a gradually changing output d is obtained from the time constant circuit 6 so that the motor driving voltage 3 becomes sufficient for applying a bodily sensation through the driver 7.

The motor driving voltage e is fed to a motor 8 shown in FIGS. 4*a* and 4*b* so that the electricity is converted into mechanical vibrations, the operation of which will be described later in detail.

Figure 3A:
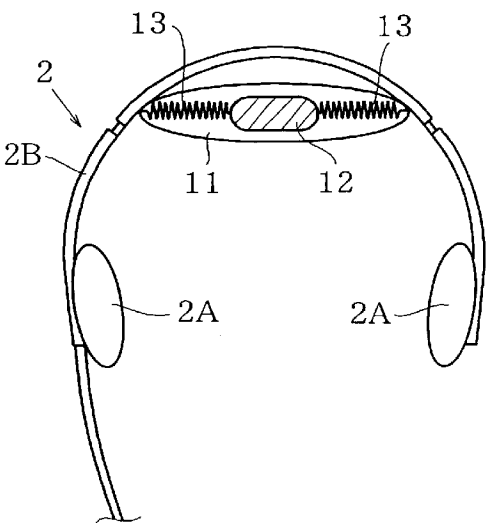
FIGS. 3*a* to 3*c* are illustrations showing headphones having various electromechanical vibration transducers.

Referring to FIG. 3*a*, the headphone 2 comprises a clamp 2B, a pair of ear pads 2A mounted on the clamp 2B and applied to ears of a user, each having a loudspeaker (not shown) therein. At the center of the clamp 2B with respect to the extending direction thereof, an abutting member 11 is provided. The abutting member 11 is made of elastic material capable of restoring the original shape thereof such as sponge and urethane rubber and so disposed at a position to abut on the cervix of the wearer when the headphone is worn.

On the back of the abutting member 11, there is provided an electromechanical vibration transducer 12 for converting the motor driving voltage e to the vibration. The transducer 12 is floatably supported by a pair of springs 13.

Figure 4A:
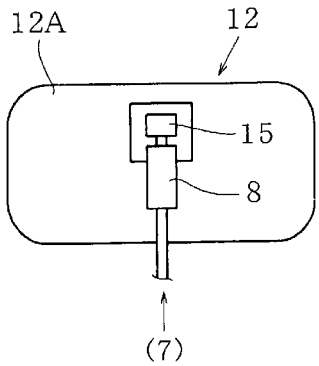
FIGS. 4*a* and 4*b* are illustrations showing structures of the examples of electromechanical vibration transducer.

Referring to FIG. 4*a*, the electromechanical vibration transducer 12 comprises a housing 12A in which is disposed the motor 8 having a shaft integrally connected to an eccentric member 15. When the motor driving voltage e is applied from the driver 7 of the motor driving section 3 shown in FIG. 1, the motor 8 is driven, thereby causing the eccentric member 15 to eccentrically rotate. Hence the housing 12A is vibrated. The vibration caused by the eccentric rotation of the eccentric member 15 is thus controlled in accordance with the rotation of the motor.

Figure 5:
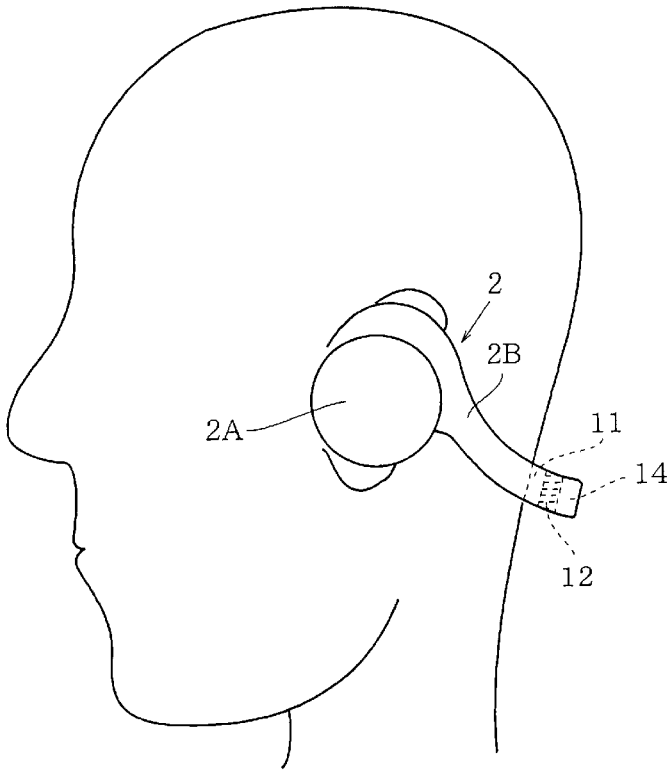
FIG. 5 is an illustration showing the headphone of the present invention worn on a head.

The vibration generated at the electromechanical vibration transducer 12 is transmitted to the abutting member 11 through the housing 12A and further directly to the cervix when the headphone 2 is worn as shown in FIG. 5.

Figure 3B:
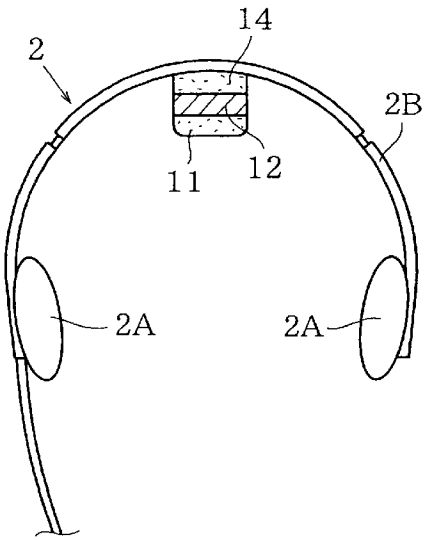
Figure 3C:
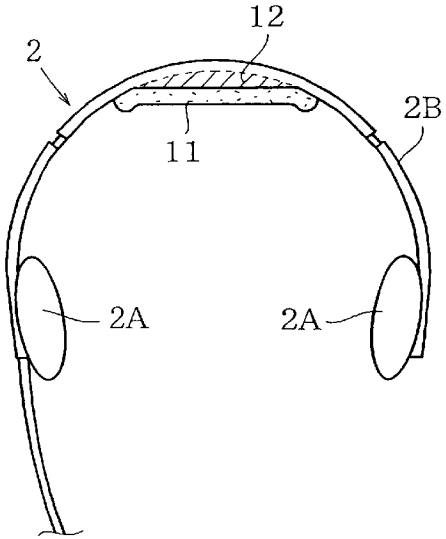

Referring to FIG. 3*b* showing another example of the headphone 2, the electromechanical vibration transducer 12 is interposed between the abutting member 11 and an elastic member 14 mounted on the clamp 2B. The electromechanical vibration transducer 12 may be pressed against the clamp 2B by the abutting member 11 so as to be supported on the clamp 2B as shown in FIG. 3*c*.

In the examples shown in FIG. 3*a* and 3*b*, the vibrations of the transducer 12 are less liable to be transmitted to the clamp 2B and hence to the loudspeakers. Namely, the transducer 12 is mechanically insulated from, or flexibly connected to the loudspeakers, which are electroacoustic transducer means provided in the ear pads 2A. As a result, when the abutting member 11 contacts the cervix, the vibrations from the electromechanical vibration transducer 12 are concentrated only on the cervix.

Figure 4B:
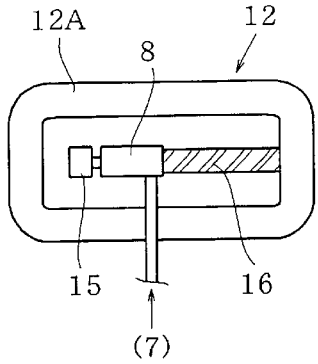

FIG. 4*b* shows another example of the electromechanical vibration transducer 12 where the motor 8 and the eccentric member 15 are supported in the housing 12A by a cantilevered resilient supporting member 16 such as a leaf spring, the original shape of which can be restored. In the electromechanical vibration transducer 12 of such a structure, the resonance frequency is determined dependent on the compliance of the resilient supporting member 16 and the mass of the motor 8 and the eccentric member 15. Hence the amplitude characteristic can be largely improved. As a result, it becomes possible to effectively vibrate the electromechanical vibration transducer 12 itself using a resonance having a large Q factor, which is determined in accordance with the compliance of the supporting member 16 and the mass of the motor 8 and the eccentric member 15. The Q factor in the present instance indicates the sharpness of mechanical resonance in the low resonance frequencies.

Figure 6:
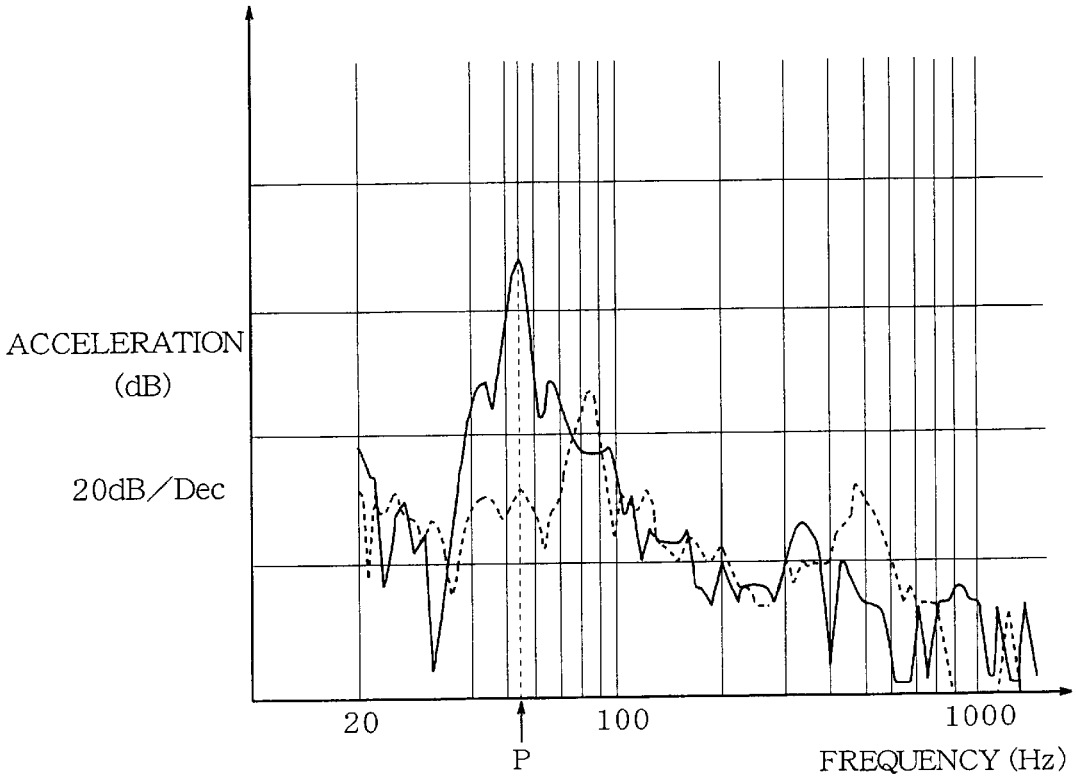
FIG. 6 is a graph showing amplitude characteristics in the electromechanical vibration transducer s shown in FIGS. 4*a* and 4*b;*

FIG. 6 is a graph showing the frequency responses of the electromechanical vibration transducer 12 shown in FIGS. 4*a* and 4*b*. The dotted line in FIG. 6 shows the frequency response when the electromechanical vibration transducer 12 of FIG. 4*a* is used, and the solid line shows that of the electromechanical vibration transducer 12 of FIG. 4*b*.

As shown at a point P of the bold line in the graph, in the structure of FIG. 4*b*, the amplitude characteristic of the motor 8 and the eccentric member 15 is much improved in the low resonance frequency range.

Figure 2:
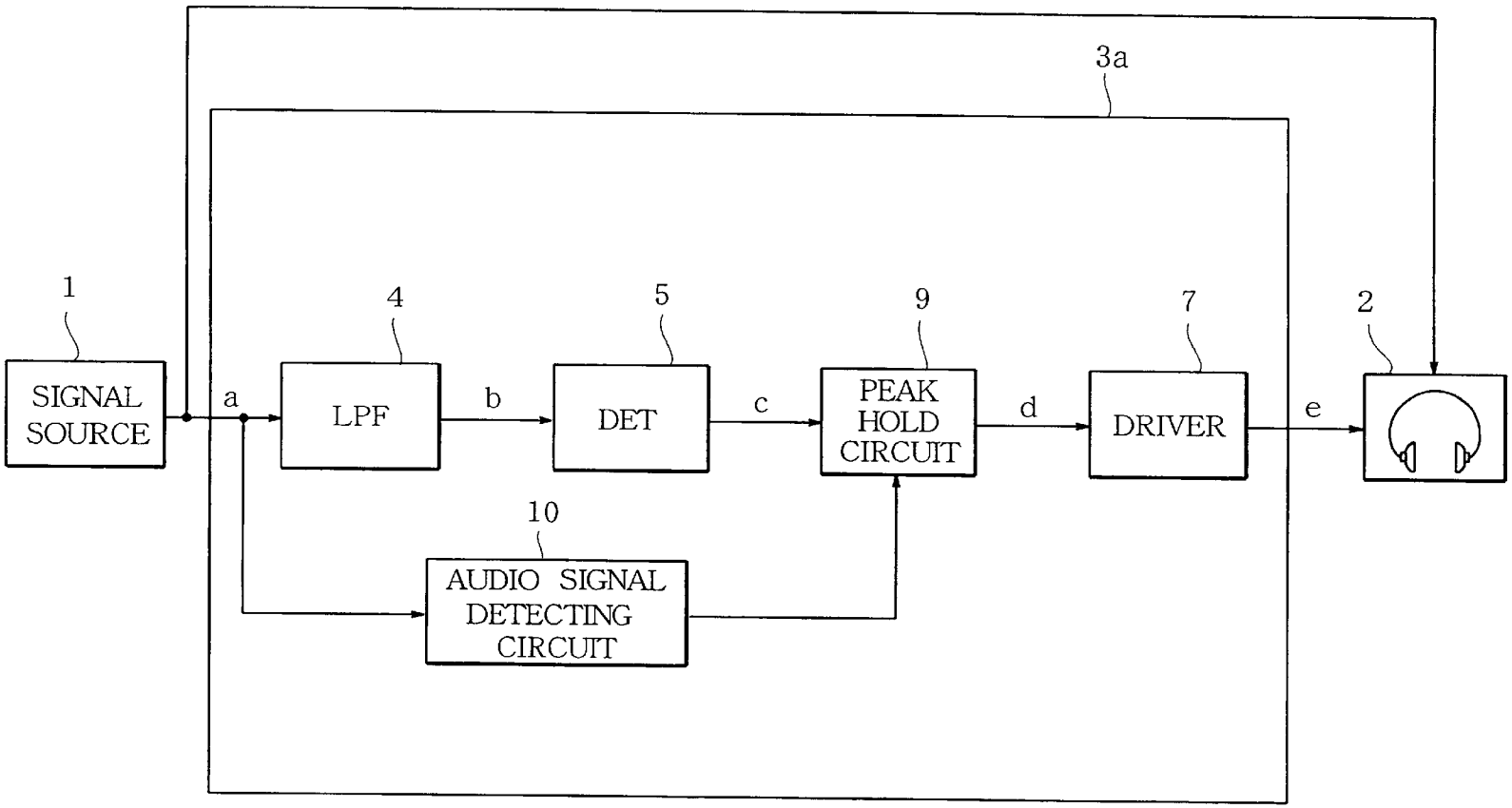
FIG. 2 is a block diagram showing a modification of the embodiment of FIG. 1.

FIG. 2 shows a modification of the present invention. A motor driving section 3*a* has a peak hold circuit 9 between the detector circuit 5 and the driver 7. Thus the peak of the direct current component c including the low frequency component extracted at the detector circuit 5 is held. A peak hold output d' from the peak hold circuit 9 is fed to the driver 7 so as to be converted into the motor driving voltage e which is applied to the headphone 2.

The motor driving section 3*a* is further provided with an audio signal detecting circuit 10 to which the audio signal a from the signal source 1 is applied. The audio signal detecting circuit 10 detects the existence of the audio signal. When the audio signal is interrupted, the audio signal detecting circuit 10 applies a control signal to the peak hold circuit 9 to prohibit the peak hold operation.

The second embodiment of the present invention wherein the timbre of the sound from the headphone is changed in accordance with the vibration is described hereinafter with reference to FIG. 7. The timbre in general relates both to frequency and to time. In the hereinafter described embodiment, the timbre with respect to frequency is controlled with the use of an equalizer.

Figure 7:
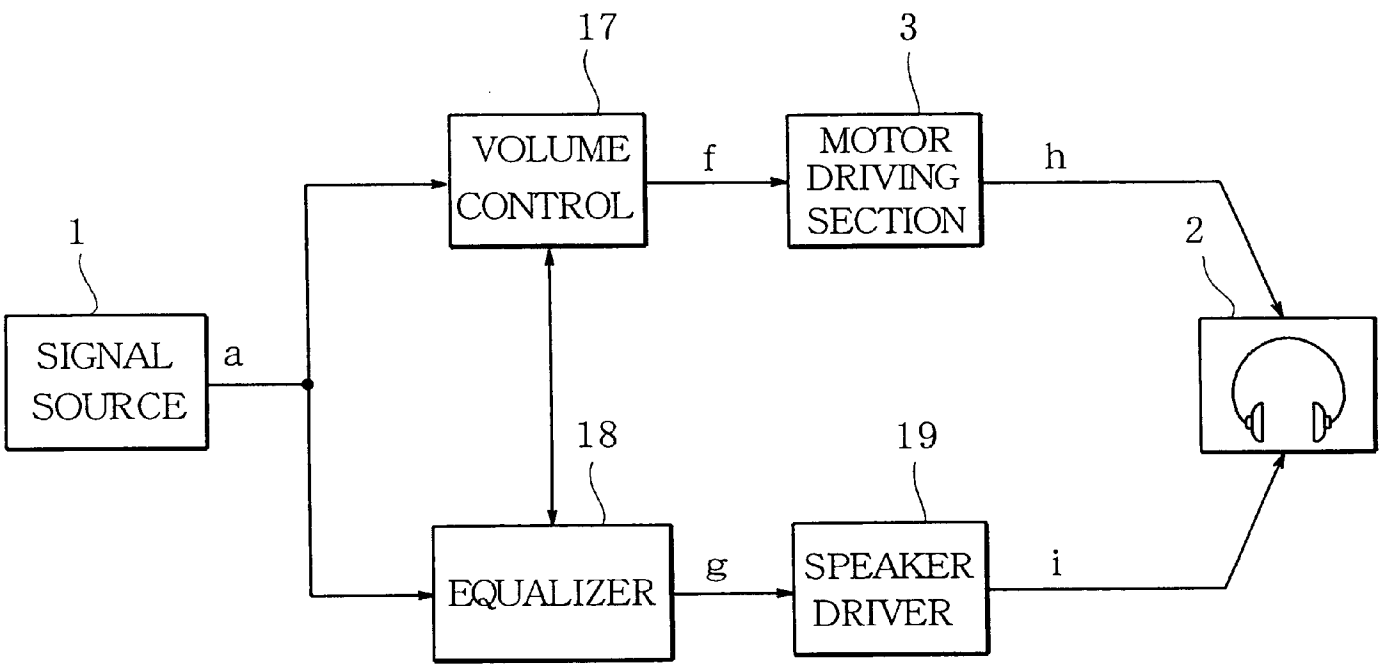
FIG. 7 is a block diagram showing a second embodiment of the present invention.

Referring to FIG. 7, the acoustic signal a is fed to a volume control 17 for controlling the level of the acoustic signal a and for applying a controlled acoustic signal f to the motor driving section 3 which has been described in detail. The acoustic signal a is further fed to an equalizer 18 which detects the level of the volume set at the volume control 17 and controls the frequency response of the audio signal a in accordance with the volume level to generate a corrected audio signal g. The corrected audio signal g is fed to a speaker driver 19, which in turn applies a driving signal i to the loudspeakers provided in the headphone 2.

Figure 8:
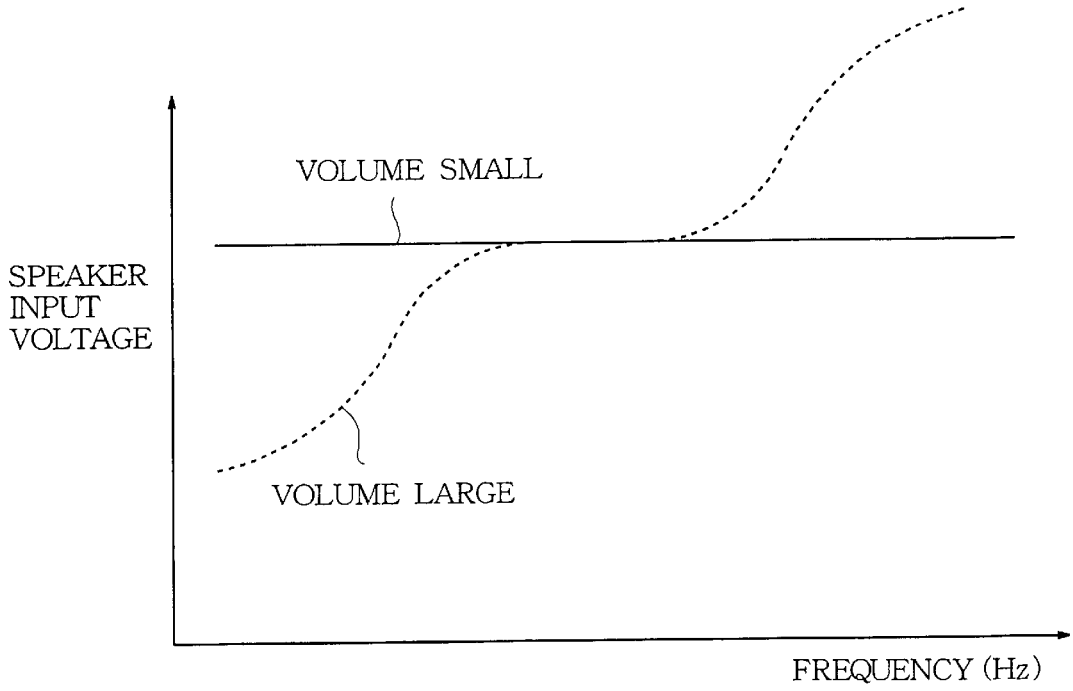
FIG. 8 is a graph showing a relationship between frequency and input voltage of a loudspeaker in the second embodiment of the present invention.

For example, when the level of the volume set at the volume control 17 is large, the level of the low frequency components in the audio signal a is reduced or the level of the high frequency components is increased as shown by the dotted line in FIG. 8. Thus, when the level of the vibrations caused by the low frequency components is large, the acoustic low frequency components applied through the loudspeakers are reduced. Accordingly, the audio signal in the low frequency range is mostly concentrated on the vibrations felt through the bodily sensation. Thus sufficient bodily sensation can be obtained without oppressing the head of the wearer.

From the foregoing it will be understood that the present invention provides a headphone wherein the bodily sensation is applied through a vibrating member disposed at the cervix of the wearer. Since the bodily sensation and the auditory sensation are applied to different parts of the body, bodily sensation can be felt in accordance with the music heard through the ears. Thus, sufficient bodily sensation can be obtained without giving the wearer an unpleasant feeling.

While the invention has been described in conjunction with preferred specific embodiment thereof, it will be understood that this description is intended to illustrate and not limit the scope of the invention, which is defined by the following claims.

What is claimed is:

1. An audio device comprising:

an electroacoustic transducer mounted on a clamp for converting an electric signal into an acoustic signal;

an electromechanical vibration transducer for converting a low frequency component of the electric signal into a mechanical vibration; and an abutting member having the electromechanical vibration transducer therein and mounted on the clamp so that the electromechanical vibration transducer is located in a middle center of a cervix of a user in order to prevent a bodily sensation from intermingling with an auditory sensation when the audio device is worn on the head of the user.

2. The audio device according to claim 1 wherein the electromechanical vibration transducer is provided with an elastic abutting member so disposed to contact the cervix of the user when the audio device is worn on the head.

3. The audio device according to claim 1 wherein the electromechanical vibration transducer has a vibration generator and is mounted in a housing by a resilient supporting member.

4. The audio device according to claim 1 wherein the electromechanical vibration transducer has a motor and an eccentric member mounted on a rotating shaft of the motor.

5. This audio device of claim 4, further comprises a motor drive unit configured to extract a low frequency component of said electric signal and to drive said motor with said extracted low frequency component.

6. The audio device according to claim 5, wherein said motor drive unit is provided with a low-pass filter.

7. The audio device according to claim 1 wherein the electroacoustic transducer is mechanically insulated from the electromechanical vibration transducer.

8. The audio device according to claim 1 wherein the electroacoustic transducer is flexibly connected to the electromechanical vibration transducer.

9. The audio device according to claim 1 further comprising a timbre controlling means for controlling a timbre dependent on the electric signal in accordance with the vibration generated by the electromechanical vibration transducer and applying the controlled electric signal to the electroacoustic transducer.

10. The audio device of claim 8, wherein said timbre controlling means controls said electrical signal such that an amplitude level of an acoustic low frequency component applied to said electroacoustic transducer is lowered according to an amplitude level of vibration caused by the said electromechanical vibration transducer.

* * * * *